US008141634B2

(12) United States Patent
Fisher et al.

(10) Patent No.: US 8,141,634 B2
(45) Date of Patent: Mar. 27, 2012

(54) RELEASING AND RECOVERING TOOL

(75) Inventors: Jerry W. Fisher, Tomball, TX (US); Thomas M. Redlinger, Houston, TX (US); Carl J. Wilson, Hockley, TX (US); Mary L. Laird, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 427 days.

(21) Appl. No.: 11/842,837

(22) Filed: Aug. 21, 2007

(65) Prior Publication Data

US 2008/0041597 A1 Feb. 21, 2008

Related U.S. Application Data

(60) Provisional application No. 60/823,028, filed on Aug. 21, 2006.

(51) Int. Cl.
*E21B 17/06* (2006.01)

(52) U.S. Cl. ..... 166/250.13; 166/301; 166/242.6; 175/320

(58) Field of Classification Search ..... 166/250.13, 166/377, 301, 98, 378; 175/320, 321
See application file for complete search history.

(56) References Cited

U.S. PATENT DOCUMENTS

| | | | | |
|---|---|---|---|---|
| 2,409,811 | A | | 10/1946 | Taylor, Jr. et al. |
| 2,678,806 | A | * | 5/1954 | Brown ..... 175/321 |
| 2,719,362 | A | | 10/1955 | Montgomery et al. |
| 2,719,363 | A | * | 10/1955 | Franklin et al. ..... 33/544.3 |
| 2,726,848 | A | * | 12/1955 | Montgomery et al. ..... 175/321 |
| 2,868,506 | A | | 1/1959 | Nestle |
| 3,390,898 | A | | 7/1968 | Sumida |
| 3,516,703 | A | | 6/1970 | Templeton |
| 3,559,732 | A | | 2/1971 | Tucker |
| 3,628,616 | A | * | 12/1971 | Neilson ..... 175/65 |
| 4,349,072 | A | | 9/1982 | Escaron et al. |
| 4,368,911 | A | * | 1/1983 | Pringle ..... 294/86.15 |
| 4,576,402 | A | * | 3/1986 | Murray et al. ..... 285/39 |
| 4,750,560 | A | | 6/1988 | Gazda |
| 4,838,594 | A | * | 6/1989 | Bullard ..... 294/86.18 |
| 4,901,804 | A | | 2/1990 | Thometz et al. |

(Continued)

FOREIGN PATENT DOCUMENTS

GB 2 391 565 2/2004

(Continued)

OTHER PUBLICATIONS

Schlumberger's Oilfield Glossary, "Coiled Tubing Completion", Mar. 22, 2006, accsessed Mar. 23 2010 via the Internet Archive, http://www.archive.org/web/web.php.*

(Continued)

*Primary Examiner* — William P Neuder
*Assistant Examiner* — Blake Michener
(74) *Attorney, Agent, or Firm* — Patterson & Sheridan, L.L.P.

(57) ABSTRACT

Apparatus and methods for selectively releasing a first wellbore component to a second wellbore component using a disconnect device. The method includes coupling a disconnect device to a workstring and a downhole tool; performing a downhole operation using the downhole tool, and selectively releasing an upper portion of the disconnect device from a lower portion of the disconnect device, thereby releasing the downhole tool from the workstring. The method may also include reconnecting the upper portion of the disconnect device to the lower portion of the disconnect device. The disconnect device is capable of transferring torque to the wellbore component.

27 Claims, 11 Drawing Sheets

U.S. PATENT DOCUMENTS

| | | | | |
|---|---|---|---|---|
| 4,913,229 | A | 4/1990 | Hearn | |
| 5,170,847 | A | 12/1992 | Mims et al. | |
| 5,195,586 | A | 3/1993 | Gambertoglio | |
| 5,219,027 | A | 6/1993 | Taylor | |
| 5,242,201 | A | 9/1993 | Beeman | |
| 5,507,349 | A | 4/1996 | Wray et al. | |
| 5,526,888 | A * | 6/1996 | Gazewood | 175/320 |
| 5,580,114 | A * | 12/1996 | Palmer | 294/86.15 |
| 5,589,825 | A | 12/1996 | Pomerleau | |
| 5,695,009 | A | 12/1997 | Hipp | |
| 5,718,291 | A * | 2/1998 | Lorgen et al. | 166/377 |
| 5,787,982 | A | 8/1998 | Bakke | |
| 5,797,454 | A | 8/1998 | Hipp | |
| 5,810,088 | A * | 9/1998 | Lamirand et al. | 166/377 |
| 5,947,202 | A * | 9/1999 | Gazewood | 166/301 |
| 5,984,029 | A | 11/1999 | Griffin et al. | |
| 6,050,341 | A | 4/2000 | Metcalf | |
| 6,053,262 | A | 4/2000 | Ferguson et al. | |
| 6,095,583 | A * | 8/2000 | Beeman et al. | 294/86.15 |
| 6,131,953 | A | 10/2000 | Connell et al. | |
| 6,213,206 | B1 * | 4/2001 | Bakke | 166/242.7 |
| 6,269,891 | B1 | 8/2001 | Runia | |
| 6,318,470 | B1 * | 11/2001 | Chang et al. | 166/377 |
| 6,338,504 | B1 | 1/2002 | Hilliard | |
| 6,408,946 | B1 * | 6/2002 | Marshall et al. | 166/317 |
| 6,419,013 | B1 | 7/2002 | Milne et al. | |
| 6,712,146 | B2 * | 3/2004 | Estep et al. | 166/377 |
| 7,100,696 | B2 * | 9/2006 | Marshall | 166/377 |
| 7,134,493 | B2 * | 11/2006 | Runia | 166/254.2 |
| 7,140,454 | B2 | 11/2006 | Runia | |
| 7,152,674 | B2 | 12/2006 | Bowles | |
| 7,174,963 | B2 | 2/2007 | Bertelsen | |
| 7,188,672 | B2 * | 3/2007 | Berkheimer et al. | 166/254.2 |
| 7,198,101 | B2 | 4/2007 | McGarian et al. | |
| 7,213,655 | B2 | 5/2007 | Parrott | |
| 7,252,150 | B2 * | 8/2007 | Downie et al. | 166/377 |
| 7,296,637 | B2 | 11/2007 | Gudac | |
| 7,296,639 | B2 | 11/2007 | Millar et al. | |
| 7,311,346 | B2 | 12/2007 | Bakke | |
| 7,337,852 | B2 | 3/2008 | Manke et al. | |
| 7,373,974 | B2 * | 5/2008 | Connell et al. | 166/242.6 |
| 7,380,596 | B2 | 6/2008 | De Clute-Melancon | |
| 7,431,094 | B2 | 10/2008 | De Clute-Melancon | |
| 7,681,642 | B2 | 3/2010 | Bell et al. | |
| 2004/0256113 | A1 * | 12/2004 | LoGiudice et al. | 166/381 |
| 2005/0029017 | A1 | 2/2005 | Berkheimer et al. | |
| 2005/0139352 | A1 | 6/2005 | Mauldin | |
| 2007/0034372 | A1 * | 2/2007 | Moyes | 166/250.1 |
| 2008/0099210 | A1 * | 5/2008 | Gazewood | 166/377 |
| 2008/0149348 | A1 | 6/2008 | DiFoggio et al. | |
| 2008/0202767 | A1 | 8/2008 | Sheiretov et al. | |
| 2009/0266544 | A1 | 10/2009 | Redlinger et al. | |

FOREIGN PATENT DOCUMENTS

| | | |
|---|---|---|
| GB | 2 402 954 | 12/2004 |
| GB | 2 420 133 | 5/2006 |
| WO | WO 02/20939 | 3/2002 |
| WO | WO-03004825 A1 | 1/2003 |
| WO | WO 03/048501 | 6/2003 |
| WO | WO 2009/137537 | 11/2009 |

OTHER PUBLICATIONS

PCT Partial Search Report, International Application No. PCT/US2007/076442, dated Dec. 7, 2007.

GB Search and Examination Report for GB0903362.2 dated May 24, 2010.

Canadian Office Action dated Oct. 12, 2011, Canadian Application No. 2,661,169.

* cited by examiner

RELEASING AND RECOVERING TOOL

CROSS-REFERENCE TO RELATED APPLICATIONS

This application claims benefit of U.S. provisional application Ser. No. 60/823,028 filed Aug. 21, 2006, which is herein incorporated by reference in its entirety.

BACKGROUND

1. Field of the Invention

Embodiments described herein generally relate to a disconnect device for use in a wellbore. More particularly, the embodiments relate to a selectively actuated disconnect device. More particularly still, the embodiments relate to a selectively detachable and reaftachable disconnect device adapted to transfer torque to a downhole tool.

2. Description of the Related Art

In the drilling, completion, and operation of a hydrocarbon well, various wellbore components are inserted and removed from a wellbore on a lower end of a tubular string. Wellbore components include packers (to seal off production zones), motors, pumps, sensors, sliding sleeves (to control flow of fluid in and out of production tubing), hydraulically set liners (for lining during cementing of casing), whipstocks (to divert drill bit while drilling), valves, cement shoe assemblies, and drill bits.

As wellbore components are delivered and removed from a wellbore, the components or the tubular string they are attached to may become stuck in the wellbore. The problem may be exacerbated by complex wellbore geometries or previously existing obstructions in the wellbore. To permit a conveyance to be separated from a stuck component, disconnect devices are placed at intervals in the drill string. A disconnect device is a component that can be selectively separated into two portions. For example, a disconnect device disposed in a string of tubulars can permit the string to be separated and the lower part left in the wellbore for accessibility by fishing tools. Likewise, a disconnect device disposed between the end of a tubular string and a wellbore component, like a drill bit, permits the selective removal of the string of tubulars if the bit should become stuck.

Conventional pull type disconnects utilize shear pins or other frangible or soluble components to temporarily couple a first and second portion of the disconnect device together. Shear pins are designed to fail when they are subjected to a force, such as a tensile or compressive force developed across the pins. When a wellbore component is stuck and a disconnect device is disposed in a tubular string near the component, an upward force applied from the surface can cause the shear pins of the disconnect device to fail, permitting the string to be removed from the wellbore. After the tubular string is retrieved to the surface, a fishing tool is used to manipulate the stuck wellbore component.

Shear pins are sized and numbered based upon the shear force needed to operate a disconnect device. While they have been used as temporary connections in wellbores for years, shear pins have limitations. For example, forces other than the intended force may prematurely cause the shear pins to shear, thus making them unreliable. Because the shear pins can shear prematurely, additional fishing operations may be required to retrieve the prematurely disconnected wellbore component, leading to lost production time. For example, shear pins can shear prematurely when a slide hammer bangs on a shifting tool in order to shift the sliding sleeve or when a jarring device is used to dislodge a component.

Therefore, there is a need for a more reliable disconnect device for use in a wellbore. There is a further need for a disconnect device that can be selectively detached and reattached and transfer torque to a component.

SUMMARY OF THE INVENTION

In accordance with the embodiments described herein there is provided generally a method of performing a downhole operation using a downhole tool in a wellbore. The method comprising providing a disconnect device having a bottom sub and a release sub. The method further comprising coupling the disconnect device to the downhole tool and a conveyance and running the downhole tool and disconnect device into the wellbore on the conveyance. The method further includes disconnecting the release sub from the bottom sub, wherein the release sub is selectively capable of reattaching to the bottom sub.

In another embodiment, a method of performing a downhole operation using a downhole tool in a wellbore, includes providing a disconnect device having a bottom sub and a release sub; coupling the disconnect device to the downhole tool and a conveyance; running the downhole tool and the disconnect device into the wellbore on the conveyance; transferring torque from the conveyance through the disconnect device to the downhole tool; disconnecting the release sub from the bottom sub; and reattaching the release sub to the bottom sub.

In another embodiment, a disconnect device for use in a wellbore includes a bottom sub configured to couple to a component; a release sub for selectively coupling to the bottom sub, wherein the release sub is configured to be selectively detached and reattached to the bottom sub without removal from the wellbore; an actuator configured to release the release sub from the bottom sub; and a torque transferring member configured to transfer torque from the release sub to the bottom sub.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of apparatuses and methods for disconnecting from one or more Bottom Hole Assemblies (BHA) or downhole tools in a wellbore are provided. In one embodiment, a work string is provided with a bottom hole assembly (BHA) and a disconnect device. The work string is run into the wellbore on a conveyance. The disconnect device may transfer torque to the BHA while operating in the wellbore. The BHA is operated until the operation is complete or the BHA becomes stuck in the wellbore. The disconnect device may then be actuated to release a bottom sub of the disconnect device from a release sub. The bottom sub remains coupled to the BHA while the release sub remains coupled to the conveyance. The release sub may then be run out of the wellbore or reattached to the bottom sub in an effort to fish the BHA from the wellbore. Further, a downhole operation may be performed between the release sub and the bottom sub before the release sub is reattached. The release sub may transfer torque in both directions and apply tension and compression to the BHA in order to free the BHA from the wellbore. With the release sub reattached to the bottom sub the wellbore may be completed and/or the BHA may be pulled out of the wellbore.

Figure 1:
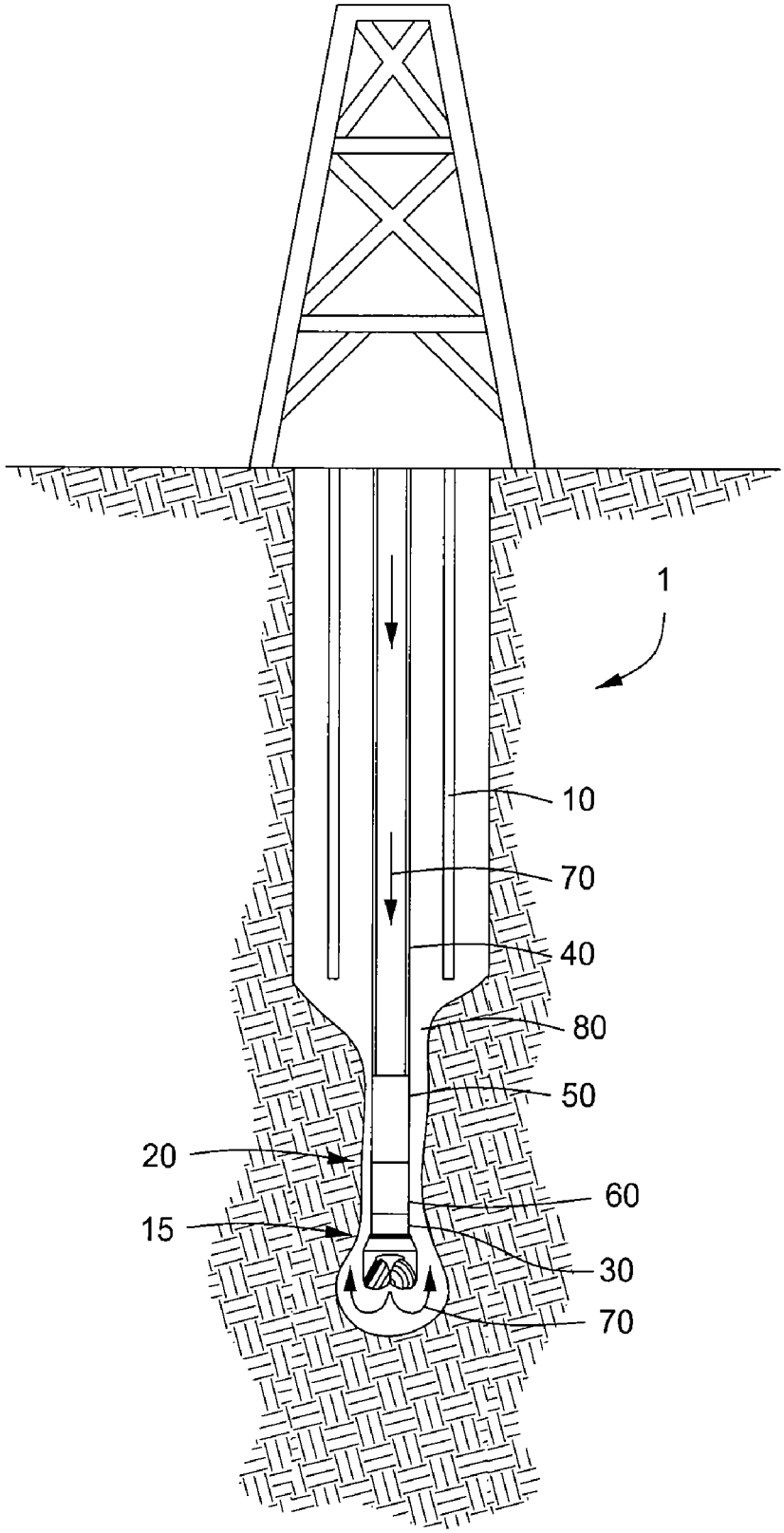
FIG. 1 is a schematic view of a wellbore and a disconnect device according to one embodiment described herein.

FIG. 1 is a schematic view of a wellbore 1 having a casing 10 and a work string 15 which includes a disconnect device 20, a BHA 30, and a conveyance 40. As shown, the conveyance 40 is a drill string which may be rotated and axially translated from the drill rig; however, it should be appreciated that the conveyance 40 could be any suitable conveyance for use in a wellbore such as a co-rod, a wire line, a slick line, coiled tubing, or casing. As shown, the BHA 30 is a drill bit; however, it should be appreciated that the BHA 30 may be any downhole tool such as a packer, a motor, a pump, a sensor, a sliding sleeve, a hydraulically set liner, a whipstock, a valve, a cement shoe assembly, a milling tool, and a conveyance. Further, the BHA 30 may be any number and combination of downhole tools. The disconnect device 20 contains a release sub 50 and bottom sub 60. A flow path 70 may be provided through the conveyance 40, the release sub 50, the bottom sub 60, and/or the BHA 30. Fluid may flow from the flow path 70 into an annulus 80 as will be described in more detail below.

Figure 2:
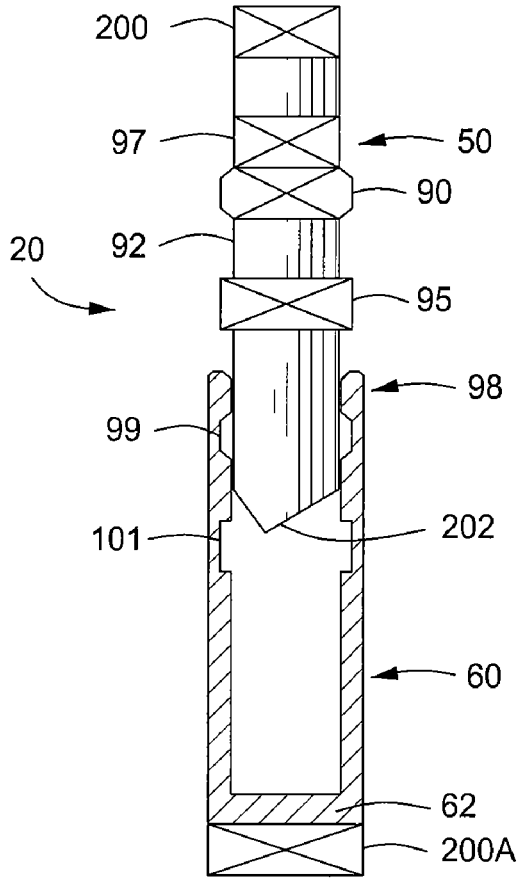
FIG. 2 is a schematic view of a disconnect device according to one embodiment described herein.

FIG. 2 is a schematic view of the disconnect device 20. The disconnect device 20 includes the release sub 50 and the bottom sub 60. The release sub 50 is designed to selectively release from and attach to the bottom sub 60 in the wellbore 1. The disconnect device 20 comprises a locking member 90 and a torsion transfer member 95. The locking member 90 selectively locks the release sub 50 to the bottom sub 60. The torsion transfer member 95 allows the release sub 50 to transfer torque to the bottom sub 60 and thereby to the BHA and/or downhole tool. The locking member 90 and the torsion transfer member 95 are shown schematically as two separate members on the release sub 50; however, it should be appreciated that the locking member 90 and/or the torsion transfer member 95 may be located on either release sub 50 or the bottom sub 60. Further, the locking member 90 and the torsion transfer member 95 may by located at the same location or be the same tool so long as the release sub 50 is selectively axially and torsionally couplable to the bottom sub 60.

The locking member 90 couples to an actuator 97, shown schematically, configured to selectively actuate the locking member 90 between a locked position and a release position, as is described in more detail below. The actuator 97 may be any suitable actuator including, but not limited to, a hydraulic actuator, a mechanical actuator, an electric actuator, a pneumatic actuator, or any combination of these actuators so long as the actuator 97 is capable of selectively locking and unlocking the locking member 90 thereby locking and unlocking the release sub 50 to the bottom sub 60.

The torsion transfer member 95 torsionally couples the release sub to the bottom sub. The torsion transfer member 95 may be a fixed member that prevents relative rotation between the release sub 50 and the bottom sub 60 when the locking member 90 is engaged. Further, the torsion transfer member 95 may be an actuatable member configured to selectively prevent relative torsional movement between the bottom sub 60 and the release sub 50.

The release sub 50 is shown having a body 92, a connector end 200, and a stabbing end 202. The connector end 200 is configured to couple the release sub 50 to the conveyance 40. The connector end 200 may be any suitable connector including, but not limited to, a threaded connection, a pin type connection, and a welded connection. The stabbing end 202 is adapted to guide the release sub into engagement with the bottom sub 60 as will be described in more detail below.

The bottom sub 60, as shown, includes a body 62, a receiving end 98 configured to receive the stabbing end 202 of the release sub 50. The receiving end 98 receives and guides the release sub 50 into connection with the bottom sub 60. The bottom sub 60 may further include a locking profile 99 and a torsion profile 101 configured to receive the locking member 90 and the torsion transfer member 95 respectively, as will be described in more detail below.

The bottom sub 60 includes a connector end 200A configured to connect the release sub to the BHA 30. The connector end 200A may be any suitable connector including, but not limited to, a threaded connection, a pin type connection, and a welded connection.

Figure 3:
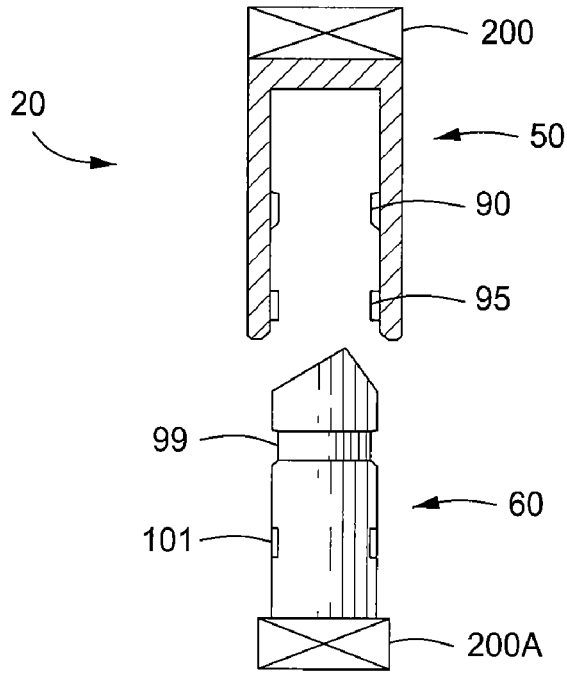
FIG. 3 is a schematic view of a disconnect device according to one embodiment described herein.

FIG. 3 a schematic view of a disconnect device 20 according to an alternative embodiment. In this embodiment, the release sub 50 is an overshot tool instead of a spear. The bottom sub 60 is a spear adapted to be engaged by the release sub 50. The release sub 50 may include the locking member 90, the torsion transfer member 95, the actuator 97, and the connector end 200, as described herein. The bottom sub 60 may include the locking profile 99 and the torsion profile 101 and the connector end 200A as described herein.

Figure 4:
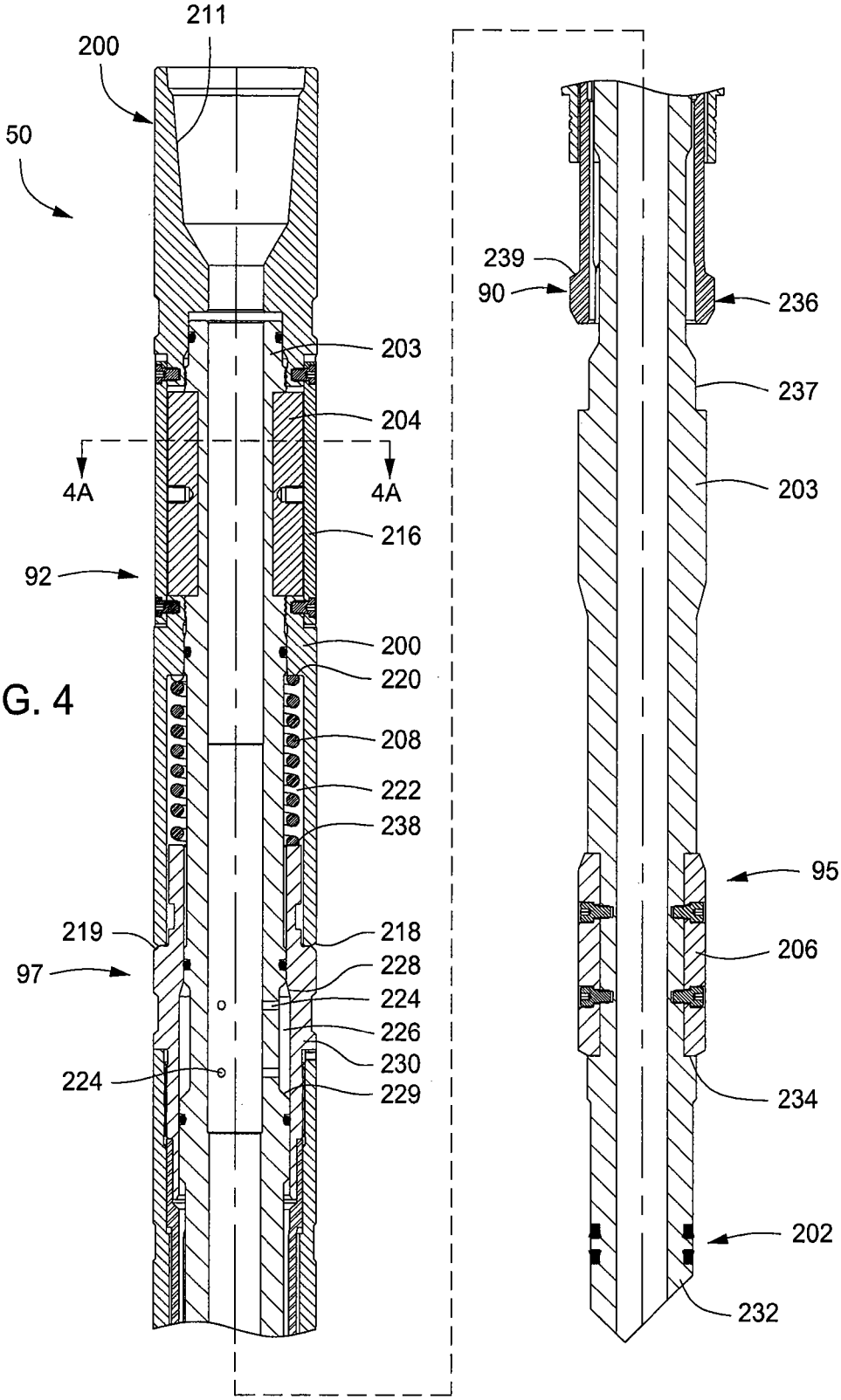
FIG. 4 is a cross sectional view of a release sub according to one embodiment described herein.

FIG. 4 is a cross sectional view of the release sub 50 according to one embodiment. The release sub 50 may be fluid actuated as will be described in more detail below. The release sub 50 comprises the body 92, the connector end 200, the locking member 90, the torsion transfer member 95, the actuator 97, and the stabbing end 202. The body 92 may include a mandrel 203, a connector member 204, and an alignment member 206.

Figure 4A:
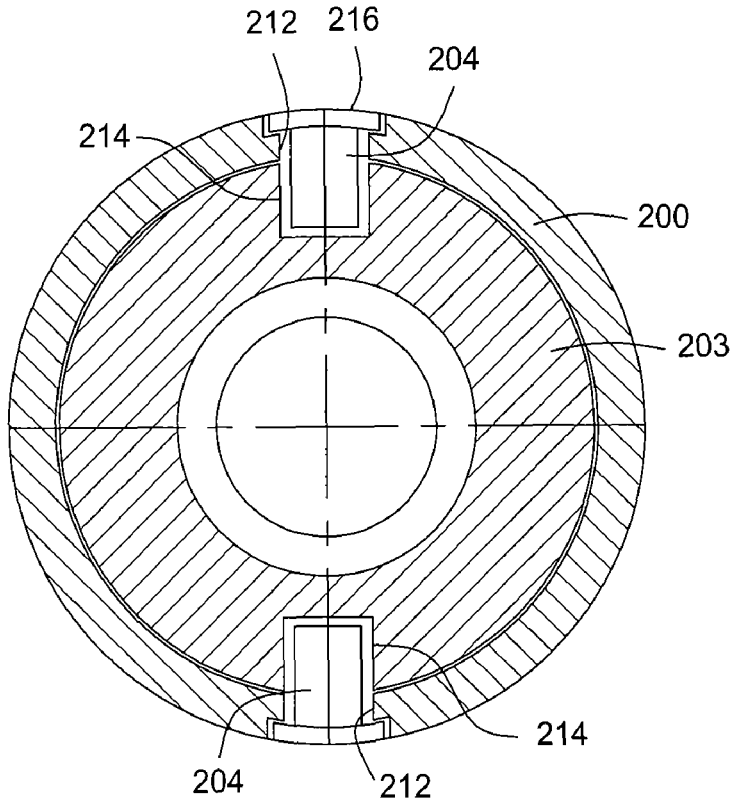
FIG. 4A is a cross sectional end view of the release sub according to one embodiment described herein.

The connector end 200 may have a box end 211 adapted to couple to a downhole end of the conveyance 40 (not shown). The connector end 200 couples the conveyance 40 to the mandrel 203. As shown, the connector end 200 couples to the mandrel 203 via the connector member 204. The connector end 200 and the mandrel 203 are shown having two slots 212 and 214, shown in FIG. 4A, for receiving the connector member 204; however, it is contemplated that any number of slots 212 may be used. The connector member 204 is located in the slots 212 and 214. A cover 216 couples to the connector end 200 and holds the connector member 204 in place. Once in place, the connector member 204 prevents relative movement between the connector end 200 and the mandrel 203 by the connector end engaging the slots 212 and 214. Although, the mandrel 203 is shown as coupled to the connector end 200 through the connector members 204, it should be appreciated that the mandrel 203 and connector end 200 may be coupled in any suitable manner or may be one unit. The lower end of the connector end 200 has a nose 218 configured to engage and house portions of actuator 97 as will be described in more detail below.

The lower end of the connector end 200 forms a nose 218. The nose 218 may limit the movement the actuator 97 as will be described below. The connector end 200 may further comprise of a shoulder 220. The mandrel 203 and the connector end 200 form a chamber 222 there between for housing a biasing member 208. The shoulder 220 may form an upper end of the chamber 222. The chamber 222 may further house an end of a piston 230 which is adapted to be acted upon by the biasing member 208.

The mandrel 203 supports the actuator 97, the locking member 90, the torsion transfer member 95, and forms the stabbing end 202. The mandrel 203 may contain ports 224 adapted to supply a fluid to a piston chamber 226 in order to apply pressure to a piston surface 228 of a piston 230 and an opposing piston surface 229 of the mandrel 203, as will be described in more detail below. The lower end of the mandrel 203 has a nose 232 and slots 234 for securing the torsion transfer member 95. The nose 232 and torsion transfer member 95 are adapted to self-align the release sub 50 with the bottom sub 60. The torsion transfer member 95 additionally provides a torque transfer function to transfer torque from the release sub 50 to the bottom sub 60. The mandrel 203 may further comprise a locking profile 237. The locking profile 237 restricts the movement of the locking member 90 when the locking member is in the locked position.

The actuator 97 may comprise a piston and chamber 210 and a biasing member 208. The piston and chamber 210 includes the piston 230 and the piston chamber 226. The piston 230 travels relative to the mandrel 203 and thereby actuates the locking member 90. A portion of the piston 230 is located in the chamber 222 and has an upper end 238 which is operatively coupled to the biasing member 208. The piston 230 may include an upset 219 adapted to engage the nose 218, thereby providing a travel stop for the piston 230 toward an unlocked position. The piston 230 and piston chamber 226 may comprise two piston surfaces, an upper piston surface 228, and a lower piston surface 229. The piston surfaces 228 and 229 influenced by fluid pressure supplied through the ports 224 in the mandrel 203 manipulate the piston 230. Fluid pressure applied to the upper piston surface 228 motivates the piston 230 and thereby the locking member toward an unlocked position. The piston surfaces 228 and 229 are shown at an angle, but it is contemplated that any angle may be used including perpendicular to the piston actuation direction. Further, the disconnect device 20 may include a frangible member adapted to hold the actuator 97 in an unactuated position until it is desired disconnect the disconnect device. Thus, to disconnect, the frangible member would be broken then the actuator 97 could be actuated to release the disconnect device 20.

In an alternative embodiment, the actuator 97 is a mechanically and/or electrically operated actuator. The mechanical and/or electrical actuator motivates the locking member 90 into and out of the locked and unlocked positions. The mechanical actuator may be any mechanical actuator including, but not limited to a mechanical spring or a cam system. An electrical actuator may include an electric motor adapted to move the locking member between the locked and unlocked positions. The electric actuator may be actuated using an RFID tag.

Figure 5:
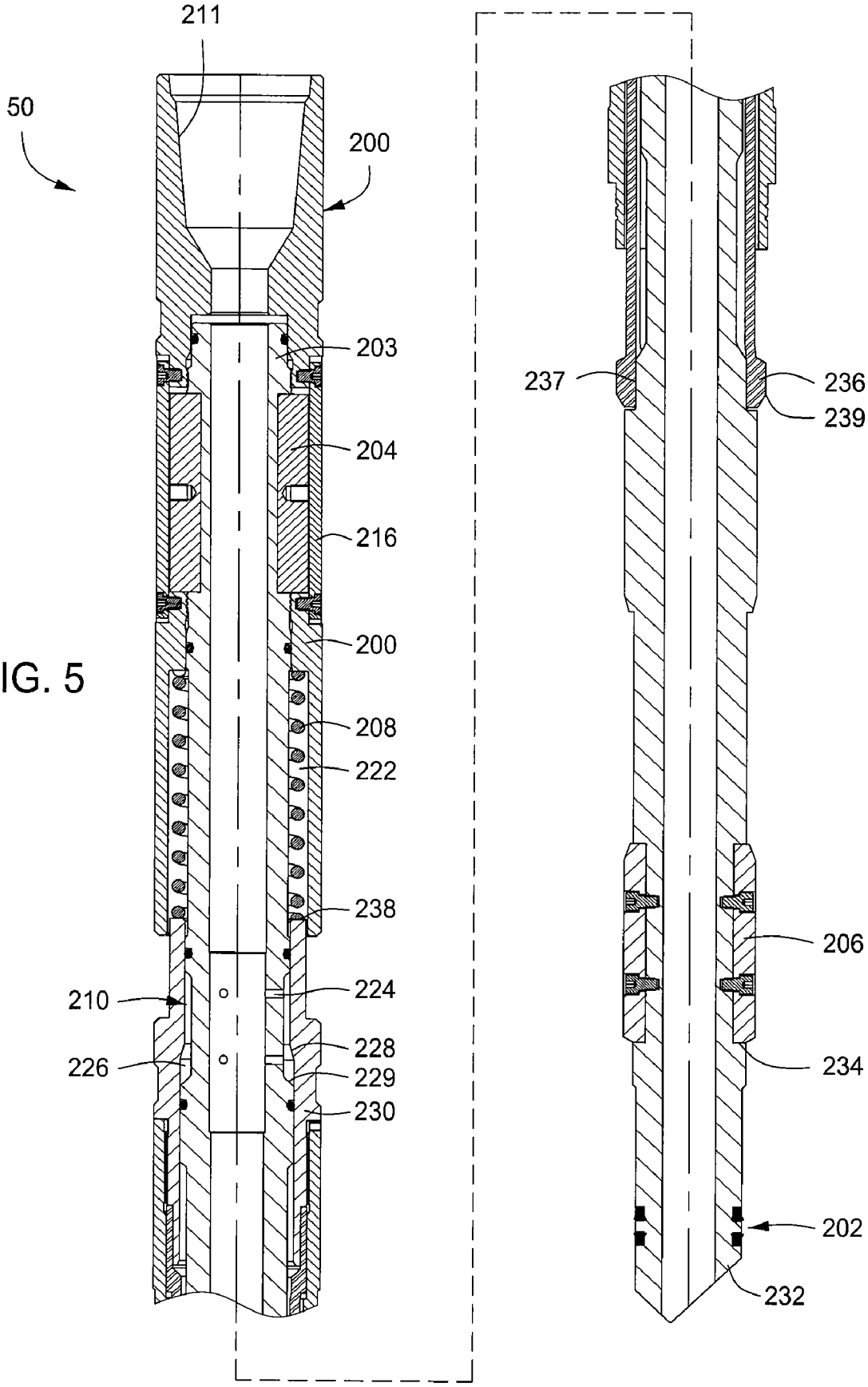
FIG. 5 is a cross sectional view of a release sub according to one embodiment described herein.

The biasing member 208 biases the piston 230 and thereby the locking member 90 toward the locked position. As shown, the piston 230 has an upper end 238 which is motivated by the biasing member 208 for biasing the piston 230 toward the locked position, as shown in FIG. 5. The biasing member 208 is shown as a coiled spring; however, it is contemplated that the biasing member may be any suitable biasing member such as a hydraulic or pneumatic biasing member, an elastic member, etc.

The locking member 90 as shown is the collet 236. The piston 230 is coupled to the collet 236. The collet 236 moves axially relative to the mandrel 203 between the release position shown in FIG. 4 and the locked position shown in FIG. 5. The collet 236 has an upset profile 239 adapted to engage the locking profile 99 of the bottom sub 60. In the locked position, an interior side of the collet 236 engages the locking profile 237 of the mandrel 203. In this position, the locking profile 237 prevents the collet 236 from moving radially inward. Thus, in the locked position the upset profile 239 of the collet 236 is engaged with the locking profile 99. In the release position, the piston 230 has moved radially up relative to the mandrel 203. The interior side of the collet 236 moves above the locking profile 99 thereby allowing the collet 236 to move radially inward. The radially movement of the collet 236 allows the collet 236 to be removed from the locking profile 99. Although the locking member 90 is described as a collet 236, other suitable locking members may be used to selectively engage and disengage the bottom sub 60 including, but not limited to, slips or locking dogs.

In one embodiment, the torsion transfer member 95 comprises one or more alignment members 206. The alignment members 206, as shown, are members coupled to the mandrel 203. The alignment members 206 extend beyond the outer diameter of the mandrel 203 and are adapted to engage a matching slot or profile in the bottom sub 60. The alignment members 206 provide a torque transfer function to transfer torque from the release sub 50 to the bottom sub 60. Additionally, the alignment members 206 may be adapted to guide the release sub 50 into proper alignment with the bottom sub 60. Although the alignment members 206 are described as being a separate member coupled to the mandrel 203, it should be appreciated that the alignment members 206 may be integral with the mandrel 203. Further, the alignment members may be coupled to the bottom sub 206 and configured to engage a slot on the mandrel 203. The alignment members 206 may take any suitable form so long as the alignment members 206 are capable of transferring torque from the release sub 50 to the bottom sub 60.

Figure 6A:
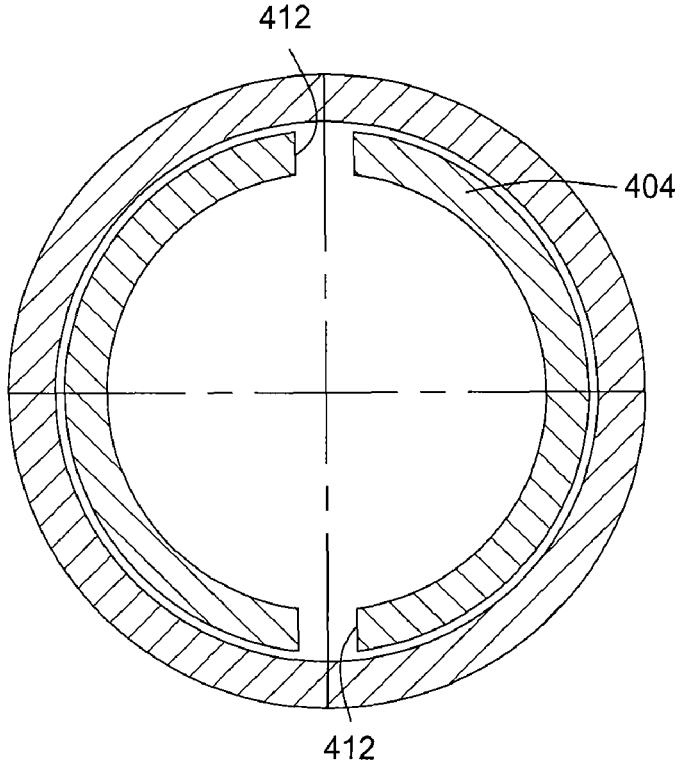
FIG. 6A is a cross sectional end view of the bottom sub according to one embodiment described herein.
Figure 6:
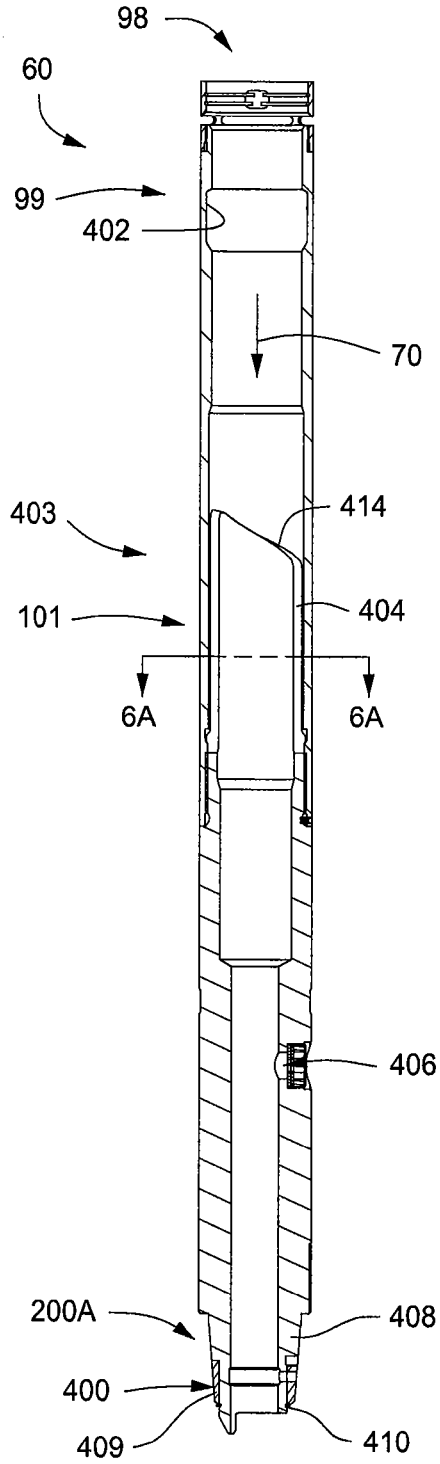
FIG. 6 is a cross sectional view of a bottom sub according to one embodiment described herein.

A cross sectional view of the bottom sub 60 is shown in FIG. 6. The bottom sub 60 includes the receiving end 98, the locking profile 99, the torsion profile 101, the connector end 200A, and an optional circulation port 406. As discussed above the bottom sub 60 is configured to selectively receive and engage the release sub 50. The receiving end 98, as shown, is simply an opening in the bottom sub 60 configured to receive the stabbing end 202 of the release sub 50.

The locking profile 99 is a fishing profile 402 in one embodiment. The fishing profile 402 is configured to receive the upset profile 239 of the collet 236 when the collet 236 is in the locked position. The fishing profile 402 may have any suitable form so long as the fishing profile 402 receives the collet 236 and prevents the collet 236 from moving from the fishing profile 402 while the collet 236 is in the locked position. Thus, with the collet 236 in the fishing profile 402 and in the locked position the release sub 50 is axially engaged with the bottom sub 60. It is contemplated that the fishing profile 402 includes one or more slots or grooves configured to prevent the rotation of the collet 236 and thereby the release sub 50 relative to the bottom sub 60.

The bottom sub 60 may further include an alignment portion 403 configured to guide and align the release sub 50. As shown the alignment portion 403 is a mule shoe 404. The mule shoe 404 may include an alignment nose 414. The alignment nose is configured to receive and maneuver the nose end 232 of the release sub 50 into the locked position. The mule shoe 404 may have one or more alignment slots 412 as shown in FIG. 6A. The alignment slots 412 are configured to receive the alignment members 206 of the release sub 50. Thus, the nose 232 of the release sub 50 enters into the mule shoe 404 as the release sub 50 travels into the bottom sub 60. The alignment members 206 encounter the alignment nose 414 of the mule shoe 404. The alignment nose 414 may rotate the release sub 50 until the alignment members 206 are in line with the alignment slots 412. The alignment members 206 continue to travel in the mule shoe 404 until the collet 236 is in the locked position. The alignment members 206 engage the alignment slots 412 when the release sub 50 is rotated, thereby preventing relative rotation between the release sub 50 and the bottom sub 60.

Figure 7:
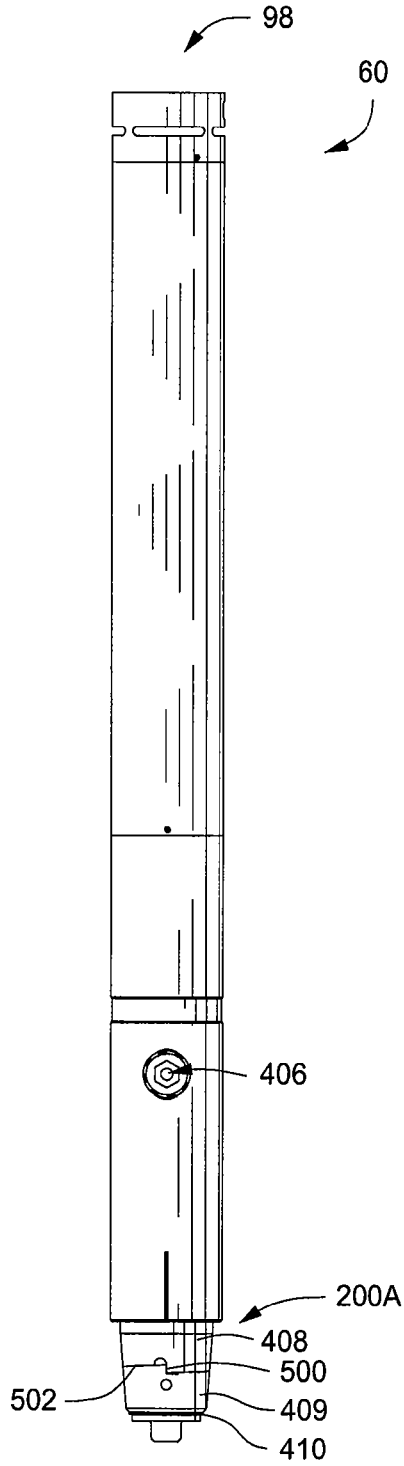
FIG. 7 is a front view of a bottom sub according to one embodiment described herein.

In one embodiment the connector end 200A of the bottom sub 60 has a threaded pin end 400. The pin end 400 may have a locking thread system for connection with a box end of the BHA 30. The pin end 400 has an upper thread portion 408 and a lower thread portion 409. The upper thread portion 408 may be immovably coupled to the bottom sub 60. The lower thread portion 409 may be adapted to rotate about the axis of the bottom sub 60. The lower thread portion 409 may be held onto the bottom sub 60 by a retaining ring 410. Each of the upper thread portion 408 and the lower thread portion 409 have a shoulder 500, as shown in FIG. 7. The shoulders 500 of the thread portions 408 and 409 are designed to allow the thread portions 408 and 409 to move as one unit when rotated in a first direction. When rotated in a second direction the shoulders 500 move apart due to the free rotation of thread portion 409. Each of the thread portions 408 and 409 have a sloped edge 502. The engagement of the sloped edges 502 push the thread portions 408 and 409 axially away from one another as the rotation in the second direction continues. The thread portions 408 and 409 moving in opposite axial directions thereby cause the threads of the thread portions 408 and 409 to lock both portions against the corresponding threads of a box member of the BHA. Thus, the pin end 400 is adapted to screw into the BHA 30 or downhole tool when rotated in a first direction, but when the pin end 400 is rotated in a second direction, the locking action prevents the inadvertent unscrewing of the bottom sub 60 from the BHA 30. Thus, rotation of the bottom sub 60 in either direction will transfer torque to the BHA 30. Although the connector ends 200 and 200A are described as threaded connections, it should be appreciated that the connector ends may be any suitable connection to the conveyance 40 and the BHA 30 including, but not limited to a collar, a drill collar, a welded connection a pinned connection.

Figure 8:
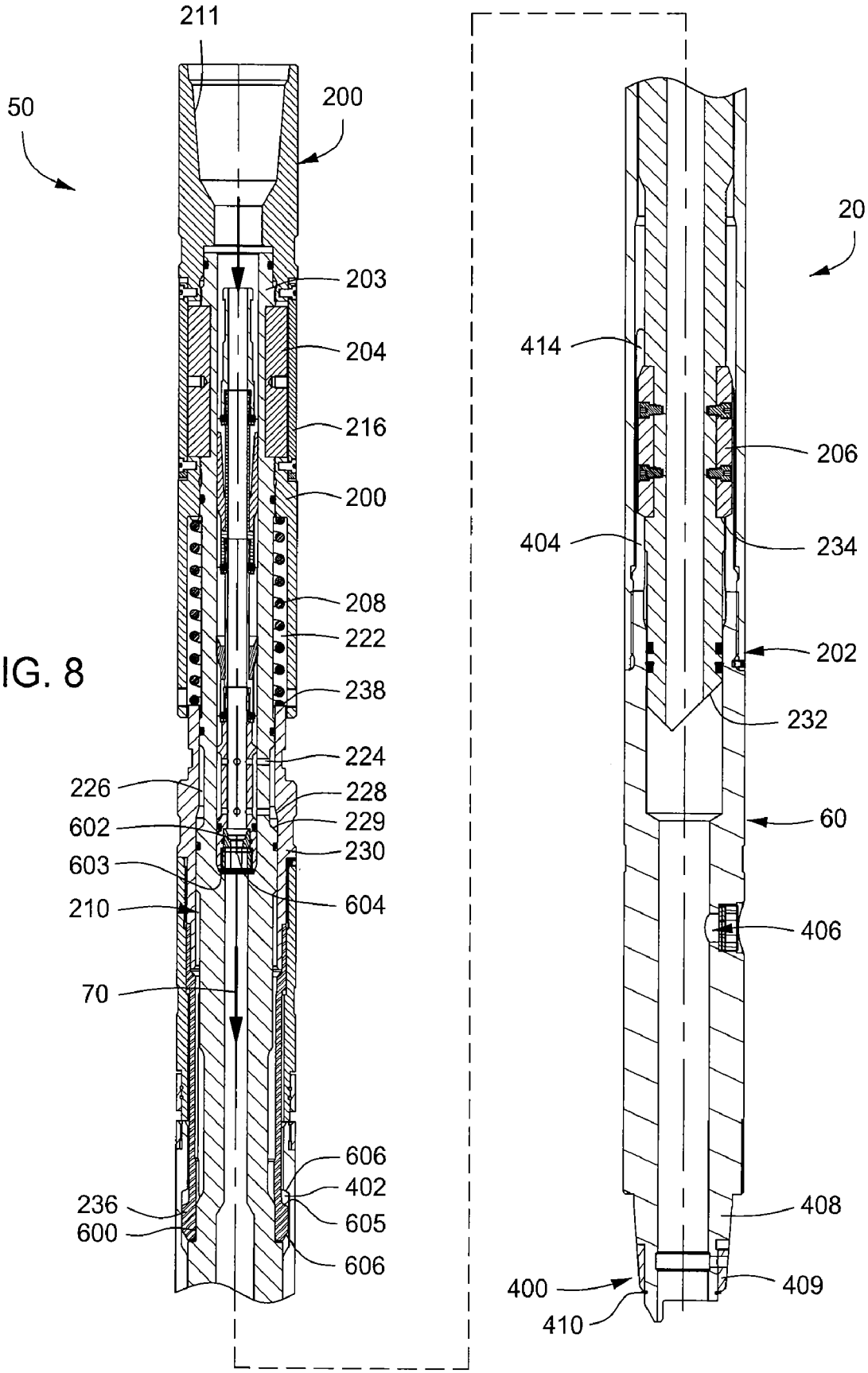
FIG. 8 is a cross sectional view of a disconnect device according to one embodiment described herein.

In one embodiment the disconnect device 20 is used in conjunction with a drilling operation. The release sub 50 and bottom sub 60 are coupled together at the surface as shown in FIG. 8. In the locked position, the collet 236 of the release sub 50 is located in the fishing profile 402 of the bottom sub 60. The locking profile 237 of the mandrel 203 retains the collet 236 within the fishing profile 402 and in the locked position. The biasing member 208 maintains a force on the piston 230 which maintains the collet 236 in the locked position. With the release sub 50 and the bottom sub 60 forming the disconnect device 20, the pin end 400 is coupled to the BHA 30 which is a drill bit and the box end 211 is coupled to the conveyance 40 as shown in FIG. 1. The work string 15 may then be rotated and lowered into the wellbore by any suitable method. The connector members 204 transfers rotation from the conveyance 40 to the release sub 50. The alignment members 206 transfer rotation from the release sub 50 to the bottom sub 60 and in turn to the drill bit. In another embodiment, a downhole motor, not shown, may be used to rotate the disconnect device 20 or the BHA 30. The wellbore may then be formed using the workstring 15 while flowing fluids through the disconnect device 20 to lubricate the drill bit and wash cuttings up the annulus 80.

When the drilling operation is complete, the entire workstring 15 may be removed from the wellbore 1 by methods known in the art. If the BHA 30 becomes stuck in the wellbore 1, the disconnect device 20 may be used to free the BHA 30. The conveyance 40 may be rotated in either rotational direction and moved axially in either direction in an attempt to free the workstring 15 from the wellbore 1. If attempts to force the workstring 15 free fail, an operator may disconnect the release sub 50 from the bottom sub 60.

To disconnect the release sub 50, a dart 602 or ball may be dropped down the conveyance 40 until it lands on a seat 603. The dart 602 may have a flow path restriction 604 or may fully obstruct the flow path 70. Alternatively or additionally, the dart 602 may be placed in the disconnect device 20 before it is run into the wellbore 1. With the dart 602 on the seat 603, the fluid pressure may be increased through the ports 224 and into the piston chamber 226. The increased fluid pressure applies a force on the piston surfaces 228 and 229 which opposes the biasing force created by the biasing member 208. Although the pressure increase is accomplished using a dart, it should be appreciated that other methods for increasing the fluid pressure may be used including, but not limited to, pumping down the drill string and creating back pressure against the BHA, or creating a back pressure against a downhole tool located in the disconnect device 20. The fluid pressure is then increased until the force on the piston surfaces 228 and 229 is greater than the force of the biasing member 208. The force on the piston surfaces 228 and 229 may also have to overcome the weight of the bottom sub 60 and any of the BHA 30 hanging from the bottom sub 60. Because the bottom sub 60 and the BHA 30 both hang from the collet 236, the weight of the bottom sub 60 and the BHA 30 may create an additional force that acts in conjunction with the biasing force to keep the disconnect device 20 in the locked position. The force created by the weight of the bottom sub 60 may be overcome by increasing the fluid pressure above the dart 602 and/or by lowering the conveyance 40 to neutralize the effect of the weight. With the force on the piston surfaces 228 and 229 greater than the biasing force and weight force, the biasing member 208 compresses due to relative movement between the piston 230 and the mandrel 203, as shown in FIG. 4. As the biasing member 208 is compressed toward the release position, there is relative movement between the mandrel 203 and the bottom sub 60, that is the mandrel 203 may move downward relative to the bottom sub 60. The collet 236 retains the bottom sub 60 until the locking profile 237 of the mandrel 203 is no longer juxtaposed against the fingers of the collet 236. With the collet 236 no longer supported by the locking profile 237, further relative axial movement between an angled collet surface 605 and an angled fishing profile surface 606 move the fingers of the collet 236 radially inward to a position where the collet 236 is free from the fishing profile 402. The release sub 50 may then be removed from the bottom sub 60 using the conveyance 40.

With the release sub 50 free from the bottom sub 60, the conveyance 40 may remove the release sub 50 from the wellbore 1 or reattach it to the bottom sub 60. To reattach the release sub 50 to the bottom sub 60, the conveyance lowers the release sub 50. The nose 232 of the release sub 50 is angled in a manner that will guide the release sub 50 into the top of the bottom sub 60 and eventually into the mule shoe 404 as the release sub 50 travels into the bottom sub 60. The alignment members 206 then encounter the alignment nose 414 of the mule shoe 404. The alignment nose 414 may rotate the release sub 50 until the alignment members 206 are in line with the alignment slots 412, shown in FIG. 6A. The release sub 50 continues to move downward with the collet 236 in the locked position until the collet 236 encounters the bottom sub 60. The bottom sub 60 will encounter the lower fishing profile surface 606. As the release sub 50 continues to be forced down, the force overcomes the biasing force and moves the mandrel 203 down, relative to the collet 236, to the release position, as shown in FIG. 4. The release sub 50 may then be lowered until the collet 236 is in the fishing profile 402. The downward force is then decreased to allow the biasing member 208 to move the mandrel 203 relative to the piston 230 to the locked position as shown in FIG. 8. The disconnect device 20 may then be used to continue downhole operations. Therefore, the release sub 50 may be attached, released, and reattached any number of times as required.

Although the disconnect device 20 is described in connection with a drill bit, it should be appreciated that any BHA 30 may be used in a downhole operation with the disconnect device 20.

In one embodiment, a communication path may be created from the flow path 70 to the annulus 80. The circulation port 406 may be always open or include a rupture disk (as shown), a pop off valve, a sliding sleeve, or a fluid operable sliding sleeve in order to selectively create the communication path to the annulus 80. The sizing of the flow path restriction 604 of the dart 602 and the rating of circulation port 406 opening mechanism may be configured in order to provide operational flexibility of the communication path with annulus 80.

In one embodiment, the flow path 70 through the disconnect device 20 is large enough to allow downhole tools, such as perforating guns, and logging tools to travel through.

Embodiments of the disconnect device 20 may be used to perform various wellbore operations including perforation, fluid injection, well stimulation, cementing, obtaining a sample, a cleaning operation, free point logging, and combinations thereof.

In another alternative embodiment, the release sub 50 includes a tool seat or profile (not shown). The tool seat is adapted to locate a tool, for example, a logging tool or a perforating tool once the disconnect device 20 is in the wellbore 1. The disconnect device 20 is run into the wellbore 1 to a desired location. The release sub 50 may then be disconnected from the bottom sub 60. The tool may then be dropped or manipulated into the conveyance 40 and eventually land on the tool seat. The tool may then perform a downhole operation such as a logging operation. Once the operation is complete, the release sub 50 may be reattached to the bottom sub 60 and the work string 15 may proceed with operations such as drilling.

Figure 9:
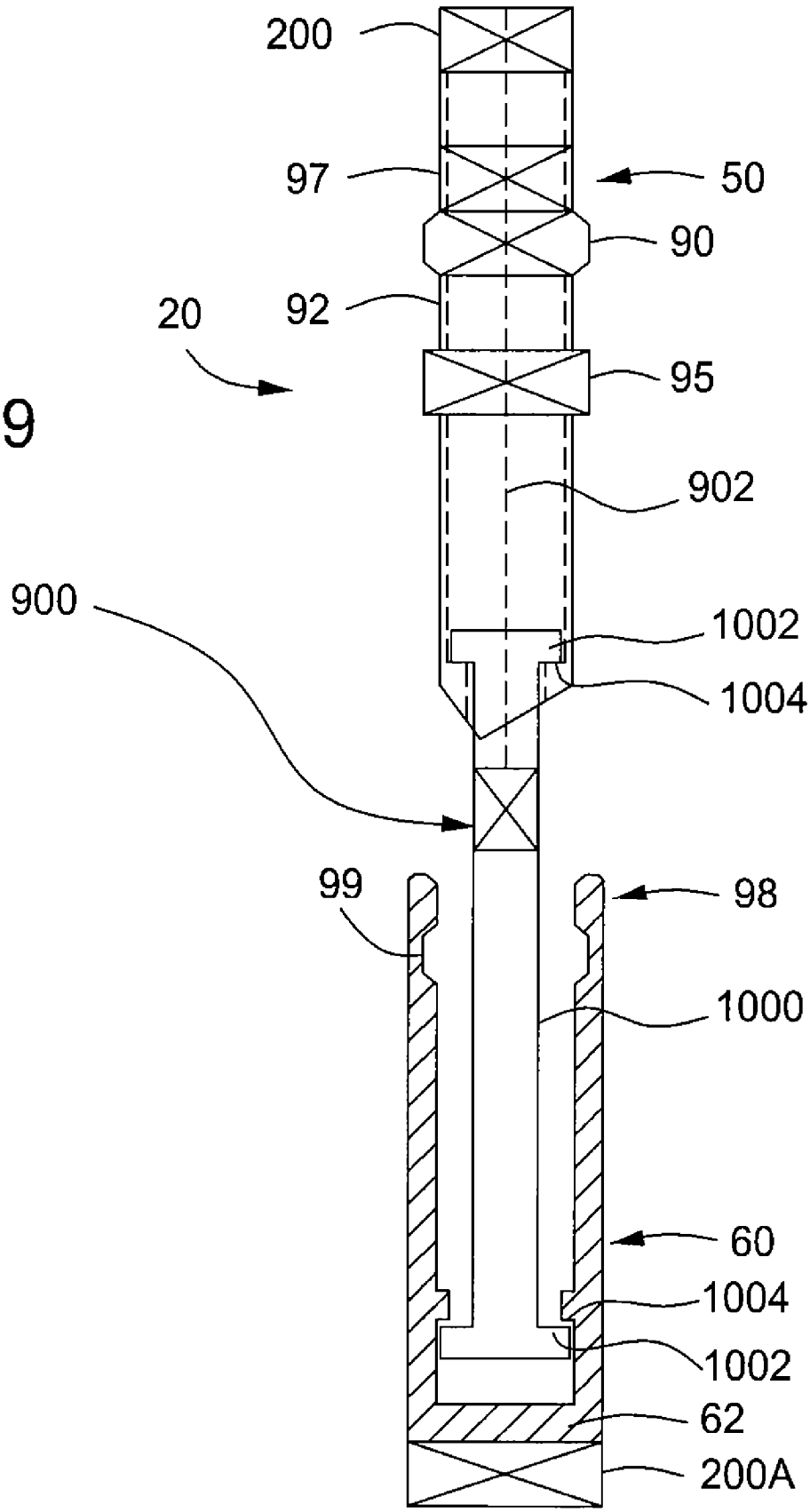
FIG. 9 is a schematic view of a disconnect device according to one embodiment described herein.

FIG. 9 depicts a schematic view of the disconnect device 20 according to an alternative embodiment. The disconnect device 20 includes an auxiliary sub 1000. The auxiliary sub 1000 is adapted to allow the release sub 50 to continue to be coupled to the bottom sub 60 after the bottom sub 60 has been released from the release sub 50. As shown, the auxiliary sub 1000 has a lip 1002 on both the release sub end and the bottom sub end of the auxiliary sub 1000. The lip 1002 is adapted to engage an inner shoulder 1004 of both the release sub 50 and the bottom sub 60. Therefore, the release sub 50 disconnects from the bottom sub 60 and is moved up relative to the bottom sub 60. The release sub 50 or the bottom sub 60 may continue to move away from the other sub 50/60 until both of the lips 1002 engages the inner shoulder 1004. With the lips 1002 and inner shoulders 1004 engaged, the release sub 50 and the bottom sub 60 may not move further apart from one another. The auxiliary sub 1000 may be adapted to guide release sub 50 toward the bottom sub 60 during the reconnection process.

The auxiliary sub 1000 may be of any suitable length desired by the operator. The auxiliary sub 1000 may be a solid member or have a tubular shape with a through bore to allow fluids to be pumped through it. Further, the tubular shaped auxiliary sub 1000 may have flow ports in the walls allowing fluids to flow through the flow ports and into the annulus 80. Furthermore, the auxiliary sub 1000 may be dimensioned to allow tools conveyed on a wireline, a slickline, or dropped to pass through. The auxiliary sub 1000 may be any suitable shape so long as it allows the release sub 50 and the bottom sub 60 to detach from one another and move a predetermined distance away from one another. Further, the auxiliary sub 1000 may simply be a cord or line. The auxiliary sub 1000 may be an externally mounted sub, in yet another alternative embodiment. The auxiliary sub 1000 may include a shear pin or shearing mechanism (not shown) capable of releasing the auxiliary sub 1000 from the bottom sub 60 and/or the release sub 50 if desired.

The auxiliary sub 1000 may include a pre-installed tool 900, such as a logging tool or perforating tool. In this embodiment, the auxiliary sub 1000 suspends the bottom sub 60 from the release sub 50 while an operation is performed. The release sub 50 may then be reattached to the bottom sub 60 and more downhole operations may be performed. The pre-installed tool 900 may include a communication and/or actuation line 902. For example the communication line 902 may be a wireline capable of conveying data and/or information to and from the pre-installed tool 900. The wireline may further be capable of moving the preinstalled tool 900 and the auxiliary sub 1000 independently of disconnect device 20. The auxiliary sub 1000 may be manufactured from any suitable material such as steel, non-magnetic metals, polymers, or combinations thereof.

The disconnect device 20 may be run into the wellbore with the auxiliary sub 1000 and the pre-installed tool 900. Once the disconnect device 20 reaches a desired location, or the BHA becomes stuck, the disconnect device 20 can release the bottom sub 60 from the release sub 50. The release sub 50 may then be lifted up relative to the bottom sub 60, or vice versa thereby exposing the pre-installed tool 900 to environment surrounding the disconnect device. An operation can then be performed on the surrounding environment, for example a logging operation or a perforating operation. With the operation complete, the release sub 50 may be reconnected with the bottom sub 60 as described above. Further, the auxiliary sub 1000 may be sheared off in order to perform the downhole operation, or after the downhole operation.

In another embodiment, the pre-installed tool 900 may include a memory device, a power supply and/or an optional transmitter. The pre-installed tool 900 may store data regarding the downhole operation in the memory device. In this respect the communication line 902 is not necessary or need not be capable of conveying data. The memory device may store the data until the pre-installed tool 900 is removed from the wellbore 1. Further, the transmitter may be used to transmit the data from the wellbore during the downhole operation. Transmittal of information may be continuous or a one time event. Suitable telemetry methods include pressure pulses, fiber-optic cable, acoustic signals, radio signals, and electromagnetic signals.

Figure 10:
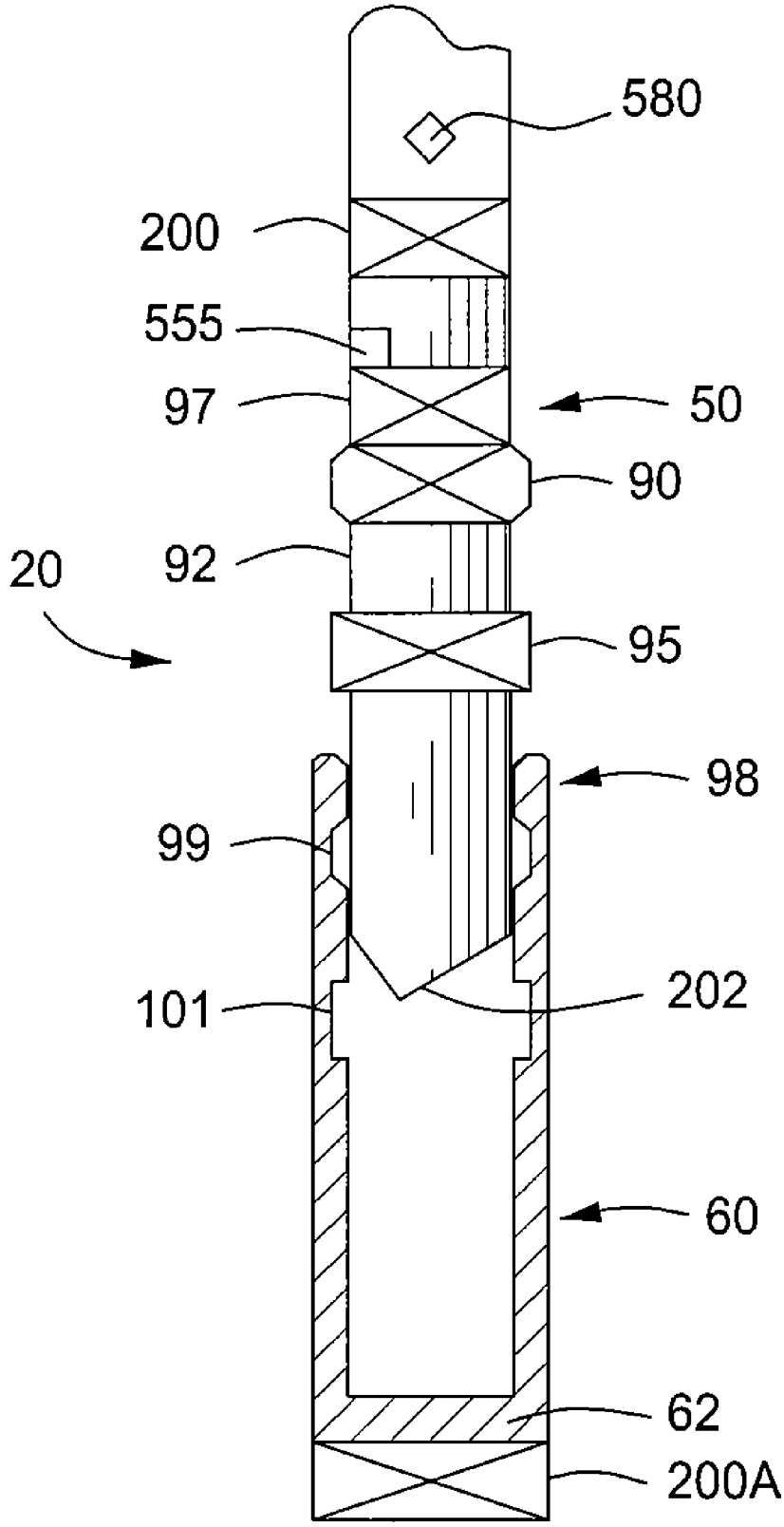
FIG. 10 is a schematic view of a disconnect device according to one embodiment described herein.

The disconnect device 20 may be actuated with a radio frequency (R.F.) tag reader. As shown in FIG. 10, a sensor 555 may be connected to the actuator 97 or the disconnect device 20 which is adapted to monitor for a RF tag 580 traveling in the wellbore 1. The RF tag 580 may be adapted to instruct or provide a predetermined signal to the sensor 555. After detecting the signal from the RF tag 580, the sensor 555 may transmit the detected signal to the actuator 97 and/or the disconnect device 20. The actuator 97 and/or disconnect device 20 would then perform an operation such as disconnecting or reconnecting the disconnect device 20.

In one embodiment, the RF tag may be a passive tag having a transmitter and a circuit. The RF tag is adapted to alter or modify an incoming signal in a predetermined manner and reflects back the altered or modified signal. Therefore, each RF tag may be configured to provide operational instructions to a controller and/or operator. In another embodiment, the RF tag 580 may be equipped with a battery to boost the reflected signal or to provide its own signal.

In another embodiment still, the RF tag may be pre-placed at a predetermined location in the work string 15 to actuate a tool passing by. For example, a logging tool may be equipped with a RF tag reader and a controller adapted to control the logging tool. As the logging tool is run into the wellbore 1, the RF tag reader broadcasts a signal in the wellbore 1. When the logging tool is near the pre-positioned tag, the tag may receive the broadcasted signal and reflect back a modified signal, which is detected by the RF tag reader. In turn, the RF tag reader sends a signal to the controller to cause the logging tool to perform a logging operation.

Figure 11:
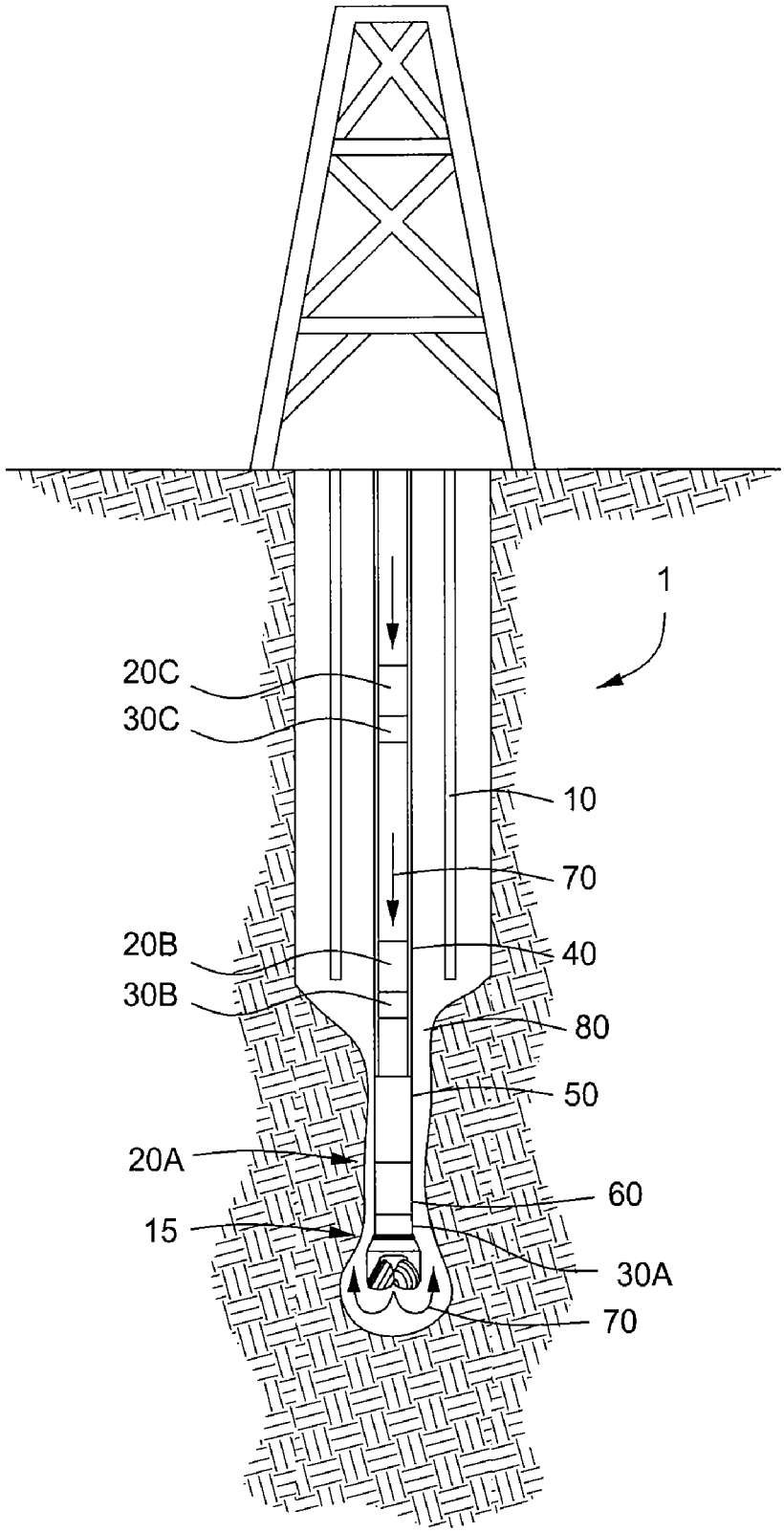
FIG. 11 is a schematic view of a wellbore and a disconnect device according to one embodiment described herein.

In another embodiment, one or more disconnect devices may be used in conjunction with one or more downhole tools. FIG. 11 illustrates an exemplary work string 15 containing three disconnect devices 20A-C. In this respect, multiple downhole operations may be performed in one trip downhole. For example, the lower downhole tool may be a BHA 30A having a drill bit. The drill bit may perform a drilling operation, after which the release sub 50 is released from the bottom sub 60, thereby leaving the drill bit and the bottom sub 60 in the wellbore 1. The next downhole tool 30B, which may be a logging tool, may then be raised to a desired location. The logging tool may then perform a logging operation. After logging, the second disconnect device 20B may optionally be actuated to release the logging tool. Thereafter, an additional operation, such as an underreaming operation, may be performed using an underreamer as the third downhole tool 30C. After completion of this operation, the third downhole tool 30C may optionally be released from the third disconnect device 20C or retrieved to surface. Other suitable downhole tools include an expansion tool, perforation tool, fishing tool, or another logging tool such as a logging while drilling tool, measuring while drilling tool, a resistivity logging tool, or a nuclear logging tool. A workstring 15 configuration with multiple disconnect devices provides flexibility in the location for disconnection. In the above example, an operator may decide to actuate the three disconnect devices 20A-C sequentially; only the lowest disconnect device 20A; the lowest 20A and the highest 20C; or any other suitable combination.

The multiple disconnect devices on the workstring 15 can be configured wherein each of the disconnect devices may be selectively actuated independently of the other disconnect devices. For example, disconnect device 20C may be released and an operation performed then reconnected. Then at a time in the future disconnect device 20A or 20B may be released. In one embodiment, the selective actuation of the disconnect devices is achieved by having a separate actuation pressure for the operation of each of the actuators in the disconnect device. Further, the selective actuation of the disconnect devices can be achieved by having different sized darts or balls for each of the disconnect devices. The different sized darts or balls may also be used in conjunction with varying actuation pressures. For example, the lowest disconnect device may have the smallest dart seat and the lowest actuation pressure for actuation and each disconnect device above the lowest disconnect device would have a slightly larger dart required for actuation. Although the selective actuation of the disconnect devices is described in conjunction with a dart and/or actuation pressure it should be appreciated that the disconnect devices may be selectively actuated by other suitable method including, but not limited to, using RFID tags having separate triggers, mechanically actuation, electronic actuation.

In an alternative embodiment, multiple disconnect devices may be used in conjunction with a free point logging tool. In this embodiment, downhole operations would continue on a work string 15 with multiple disconnect devices until a portion of the work string becomes stuck in the wellbore. With the work string 15 stuck, a free point logging operation is performed to determine the stuck point of the work string. The closest disconnect device above the stuck point may then be actuated thereby disconnecting the release sub from the bottom sub above the stuck point. A fishing operation may then be performed in order to free the stuck point. With the work string free, the release sub may be reconnected to the bottom sub and downhole operations may continue, or the workstring may be removed from the wellbore.

In another embodiment, the disconnect device 20 may be used as a fishing tool. The lower portion of the disconnect device 20 may be configured to engage the stuck object. For example, the disconnect device 20 may have a pin end 400. To fish for the stuck object such as a BHA 30, the disconnect device 20 is coupled to the conveyance 40 and run into the wellbore 1. The disconnect device 20 is conveyed downhole until the stuck BHA 30 is reached. The pin end 400 of disconnect device 20 is manipulated to engage the BHA 30. The conveyance 40 may then be used to rotate and move the BHA 30 in both rotational and axial directions. If the force provided by the conveyance 40 is sufficient to free the BHA 30, the disconnect device 20, the BHA 30, and the conveyance 40 may be retrieved from the wellbore 1. If the disconnect device 20 becomes stuck with the BHA 30, the release sub 50 may be actuated to release the release sub 50 from the bottom sub 60. The release sub 50 may then be retrieved and configured to optimize the fishing operation. The release sub 50 may be configured to include a jar, vibration tool, accelerator, or combinations thereof. The configured release sub 50 is run in to the wellbore 1 and reconnects with the bottom sub 60. Then, the added tool such as the jar may be activated to free the stuck BHA 30.

The Figures are described in conjunction with a fishing operation, a logging operation, a free point logging operation, or a perforating operation; however, it should be appreciated that other downhole operations may be performed in addition to or as an alternative to these operations. The operations that may be performed include, but are not limited to, a fluid injection operation, a well stimulation, a cementing operation, obtaining a sample, and/or a cleaning operation.

In another embodiment, the disconnect device 20 may be run in with the BHA 30. During operation, the BHA 30 may become stuck in the wellbore 1. The disconnect device 20 may be actuated to disconnect from the BHA 30 and retrieved to surface where it may be configured with a jar or other fishing tools. The configured disconnect device 20 may then be redeployed to retrieve the stuck BHA 30.

Figure 12:
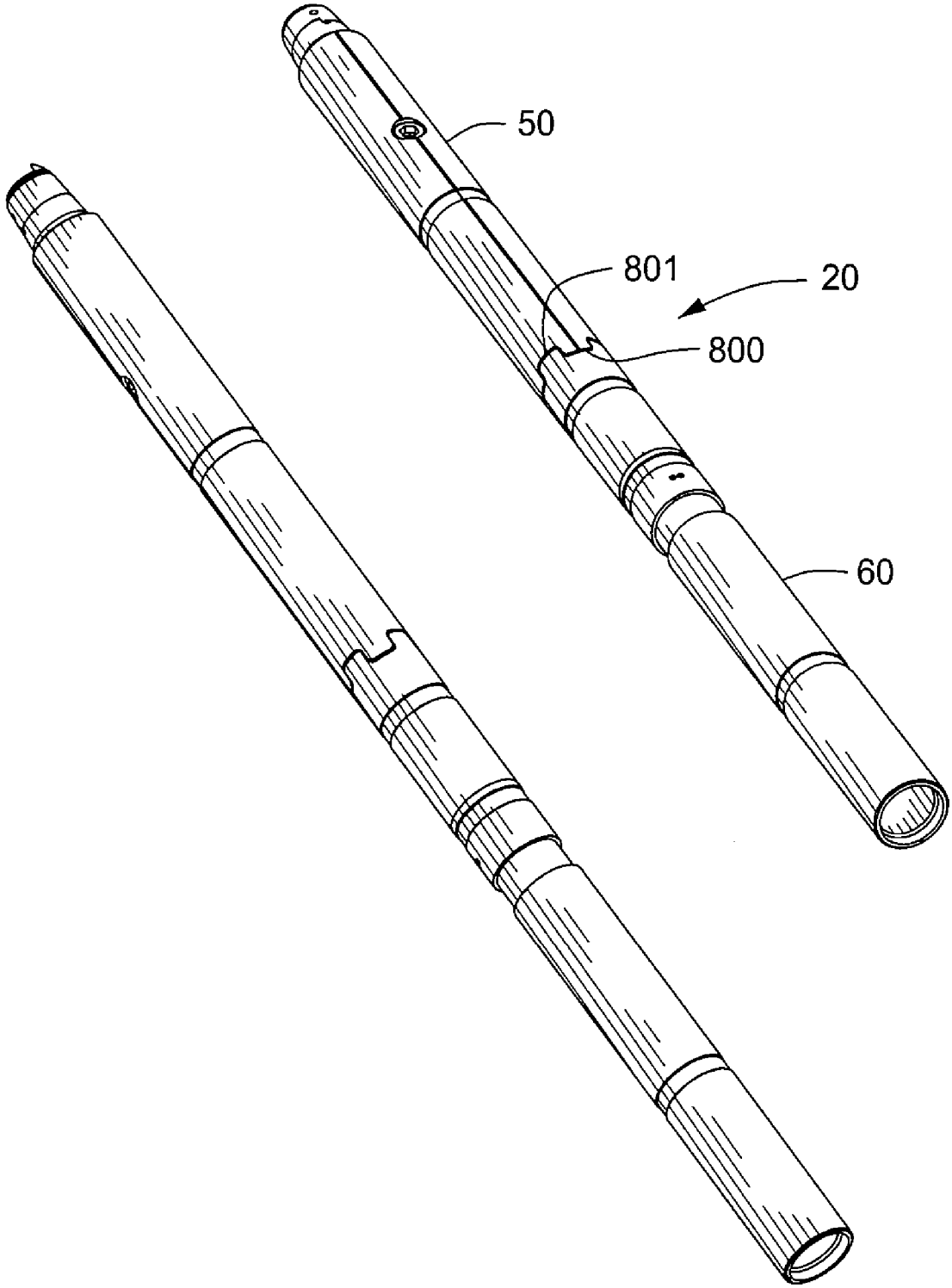
FIG. 12 is a schematic perspective view of a disconnect device according to one embodiment described herein.

In another embodiment, the release sub 50 and the bottom sub 60 may include contoured profiles 800 and 801, as shown in FIG. 12. The contoured profiles 800 and 801 are adapted to increase the disconnect device's 20 resistance to torque. Further, the contoured profiles 800 and 801 may be adapted to assist in the alignment of the release sub 50 and the bottom sub 60.

While the foregoing is directed to embodiments of the present invention, other and further embodiments of the invention may be devised without departing from the basic scope thereof, and the scope thereof is determined by the claims that follow.

The invention claimed is:

1. A disconnect device for use in a wellbore, comprising:
a first sub;
a second sub releasably coupled to the first sub;
a release mechanism configured to selectively detach and reattach the first sub to the second sub;
an actuator configured to actuate the release mechanism;
a torque transferring member configured to transfer torque from the first sub to the second sub;
a radio frequency tag configured to control the actuator; and
an auxiliary sub configured to engage the first sub and the second sub when the first sub is detached from the second sub thereby creating a maximum separation distance between the first sub and the second sub.

2. The disconnect device of claim 1, wherein the release mechanism comprises a collet and a profile, and wherein the collet is engaged in the profile when the first sub is coupled to the second sub.

3. The disconnect device of claim 2, wherein the collet couples to the second sub and the profile is formed in the first sub.

4. The disconnect device of claim 3, wherein the second sub is physically below the first sub.

5. The disconnect device of claim 1, wherein the second sub has a pin end for coupling the disconnect device to a component.

6. The disconnect device of claim 5, wherein the pin end further comprises a locking thread configured to lock the second sub to the component when a threaded connection is complete.

7. The disconnect device of claim 6, wherein:
the locking thread further comprises a first thread portion and a second thread portion, and
the second thread portion is configured to rotate with the first thread portion when the pin end is rotated in a first direction and is free to rotate independent of the first thread portion when the pin end is rotated in a second direction.

8. The disconnect device of claim 7, wherein the locking thread further comprises a cammed surface configured to move the second thread portion away from the first thread portion when the pin end is rotated in the second direction thereby locking the thread portions into a box end of the component.

9. The disconnect device of claim 1, further comprising a flow path through the first sub and the second sub.

10. The disconnect device of claim 9, further comprising a rupture disk configured to open a communication path between the flow path and an annulus surrounding the disconnect device.

11. The disconnect device of claim 1, wherein the disconnect device has an inner diameter large enough to pass a tool through the disconnect device.

12. The disconnect device of claim 11, wherein the tool is a perforating gun.

13. The disconnect device of claim 1, further comprising a pre-installed tool located on the auxiliary sub.

14. A method of drilling a wellbore, comprising:
deploying a workstring in the wellbore, the workstring comprising a conveyance, a plurality of disconnect devices, and a drill bit, wherein each of the disconnect devices comprises a sensor and an actuator;
injecting drilling fluid through the workstring and rotating the conveyance, thereby rotating the drill bit and drilling the wellbore;
determining a stuck point of the work string; and
sending an instruction signal wirelessly from the surface to the sensor closest to and above the stuck point, thereby operating the actuator and releasing at least a portion of the disconnect device and the drill bit from the rest of the workstring and freeing the rest of the workstring.

15. The method of claim 14, wherein the instruction signal is sent by deploying an RFID tag through the conveyance to the sensor.

16. A disconnect device for use in a wellbore, comprising:
a first sub having a connector formed at an end thereof;
a second sub torsionally coupled to the first sub and having a connector formed at an end thereof;
a lock longitudinally coupling the subs in the locked position and operable to release the subs in an unlocked position, wherein the lock is repeatably movable between the positions;
an actuator operable to move the lock to an unlocked position;
an RFID tag reader operable to detect a wireless signal and communicate the wireless signal to the actuator; and
an auxiliary sub operable to allow a predetermined separation distance between the first and second subs after the actuator unlocks the subs.

17. The disconnect device of claim 16, further comprising a spring biasing the lock toward the locked position.

18. The disconnect device of claim 16, wherein the lock comprises a collet and a profile.

19. The disconnect device of claim 18, further comprising a torque transferring member torsionally coupling the second sub to the first sub and comprising an alignment profile operable to rotationally align the first and second subs during re-connection of the first and second subs.

20. The disconnect device of claim 19, wherein:
the second sub connector comprises a first thread portion and a second thread portion, and
the second thread portion is operable to rotate with the first thread portion in a first direction and separate from the first thread portion in a second direction.

21. A disconnect device for use in a wellbore, comprising:

a first sub having a threaded connector formed at a first end thereof and a stab connector formed at a second end thereof, the stab connector having a nose and a torque transferring member;

a second sub torsionally and having a profile formed along an inner surface thereof and a connector formed at a second end thereof, the profile having an alignment portion and a torsion portion;

a lock longitudinally coupling the subs in the locked position and operable to release the subs in an unlocked position, wherein the lock is repeatably movable between the positions;

an actuator operable to move the lock to the unlocked position;

a sensor operable to detect a wireless signal and communicate the wireless signal to the actuator; and a torsional connection formed when the stab connector is inserted into the second sub and received by the profile, the alignment portion operable to rotate the first sub until the torque transferring member is aligned with the torsion portion and the torsion portion operable to receive the torque transferring member, wherein:

the second sub connector comprises a first thread portion and a second thread portion, and the second thread portion is operable to rotate with the first thread portion in a first direction and separate from the first thread portion in a second direction.

22. -A method of drilling a wellbore, comprising:

deploying a workstring in the wellbore, the workstring comprising a conveyance, a disconnect device, and a drill bit, wherein the disconnect comprises a sensor and an actuator;

injecting drilling fluid through the workstring and rotating the drill bit, thereby drilling the wellbore;

sending an instruction signal wirelessly from the surface to the sensor, thereby operating the actuator and releasing at least a portion of the disconnect and the drill bit from the rest of the workstring;

raising the conveyance, thereby creating a gap between the drill bit and the conveyance;

deploying a perforating gun through the conveyance to the gap; and perforating the wellbore through the gap.

23. A disconnect device for use in a wellbore, comprising:

a release sub having a threaded connector formed at a first end thereof and a stab connector formed at a second end thereof, the stab connector having a nose and a torque transferring member;

a bottom sub having a profile formed along an inner surface thereof and a connector formed at a second end thereof, the profile having an alignment portion and a torsion portion, wherein:

the bottom sub connector comprises a first thread portion and a second thread portion, and the second thread portion is operable to rotate with the first thread portion in a first direction and separate from the first thread portion in a second direction;

a lock longitudinally coupling the subs in the locked position and operable to release the subs in an unlocked position, wherein the lock is repeatably movable between the positions;

a torsional connection formed when the stab connector is inserted into the bottom sub and received by the profile, the alignment portion operable to rotate the release sub until the torque transferring member is aligned with the torsion portion and the torsion portion operable to receive the torque transferring member; and an actuator operable to move the lock to the unlocked position.

24. The disconnect device of claim 23, wherein the actuator comprises:

a piston in communication with a bore of the disconnect device, and a spring biasing the piston toward the locked position.

25. The disconnect device of claim 23, further comprising a sensor operable to detect a wireless signal and communicate the wireless signal to the actuator.

26. The disconnect device of claim 25, wherein the sensor is an RFID tag reader.

27. The disconnect device of claim 23, further comprising:

a circulation port operable to provide fluid communication between a bore of the disconnect device and an exterior thereof; and a closure member disposed in the circulation port.

* * * * *

UNITED STATES PATENT AND TRADEMARK OFFICE

CERTIFICATE OF CORRECTION

PATENT NO. : 8,141,634 B2
APPLICATION NO. : 11/842837
DATED : March 27, 2012
INVENTOR(S) : Fisher et al.

It is certified that error appears in the above-identified patent and that said Letters Patent is hereby corrected as shown below:

In the Claims:

Column 14, Claim 14, Line 29, please delete "work string" and insert --workstring-- therefor;

Column 14, Claim 16, Line 46, please delete "an" (second occurrence) and insert --the-- therefor;

Column 15, Claim 21, Line 6, please delete "torsionally and";

Column 15, Claim 22, Line 34, please insert --device-- after disconnect;

Column 15, Claim 22, Line 40, please insert --device-- after disconnect.

Signed and Sealed this
Fourth Day of September, 2012

David J. Kappos

David J. Kappos
*Director of the United States Patent and Trademark Office*